US005422147A

United States Patent [19]

Leiner et al.

[11] Patent Number: 5,422,147

[45] Date of Patent: Jun. 6, 1995

[54] METHOD AND APPARATUS FOR THE DEACIDIFICATION OF LIBRARY MATERIALS

[75] Inventors: Lee H. Leiner, New Kensington; Thomas D. Traubert, Allison Park; Robert M. Gaydos, Export, all of Pa.

[73] Assignee: Preservation Technologies, Inc., Glenshaw, Pa.

[21] Appl. No.: 105,754

[22] Filed: Aug. 12, 1993

[51] Int. Cl.[6] ..... B05D 1/18

[52] U.S. Cl. ..... 427/600; 427/439; 118/423; 118/425; 118/428; 118/503; 162/160

[58] Field of Search ..... 427/600, 439; 118/428, 118/423, 503, 425; 162/160

[56] References Cited

U.S. PATENT DOCUMENTS 4,522,843 6/1985 Kundrot ..... 427/180
4,560,592 12/1985 Friedland ..... 118/425

*Primary Examiner*—Shrive Beck
*Assistant Examiner*—David M. Maiorana
*Attorney, Agent, or Firm*—Kirkpatrick & Lockhart

[57] ABSTRACT

A method and apparatus for deacidification of cellulosic materials such as the pages of books, magazines, newspapers, documents and the like are provided which ensures that substantially the entirety of each page is treated. The method includes placing the materials within a carrier such that the pages are free for exposure to the treating medium. The carrier is submerged in a vat preferably containing a dispersion of treating material including particles of an alkaline metal oxide, hydroxide or salt. The vat includes a support frame which supports the carrier and is slidably mounted on the vat such that the carrier and materials it holds may reciprocate in a generally horizontal direction. The reciprocation of the support frame causes the pages of a book, for example, to fan out, and the treating material in the medium thus comes into contact with each page of the book, magazine or other document. After reciprocating the support frame at a preselected speed and stroke length for a preselected length of time such that each page of the book is treated, preferably in its entirety, the carrier is removed from the bath and transferred to a dryer. The dryer includes a flexible meshed webbing which is loosely draped over a series of support rods mounted on a frame. The cellulosic materials are placed on the meshed webbing and preheated air is passed through the dryer to evaporate any excess residual treating medium.

29 Claims, 5 Drawing Sheets

METHOD AND APPARATUS FOR THE DEACIDIFICATION OF LIBRARY MATERIALS

BACKGROUND OF THE INVENTION

1. Field of the Invention

The invention generally relates to a method and apparatus for the deacidification of cellulosic materials. More particularly, the invention relates to an improved method for handling the cellulosic materials such as books, magazines, newspapers, documents and the like during the deacidification process.

2. Description of the Invention Background

The deterioration of paper, books and newspapers is wellknown and of growing concern to librarians and archivists throughout the world. The causes of paper deterioration are numerous and include inherent acidity, photodegradation, oxidation, and even microbiological attack under certain conditions. These factors combined with initial paper quality have severely reduced the permanence of library and archival collections.

The demand for large amounts of printing paper over the last century has led to the introduction of pulp fiber produced from wood by chemical or mechanical means. However, paper made from untreated wood pulp is too absorbent to allow sharp image imprint. Therefore, chemicals have to be added to the wood fibers during processing. These additives allow the paper to accept inks and dyes and increase paper opacity. Unfortunately, most of these chemicals are either acidic or are deposited by acidic mechanisms which initiate the slow, but relentless acidic deterioration of paper. Other contributions to the acidification of paper are supplied by man through industrial emissions of sulphur and nitrogen and carbon oxides or by natural processes such as sea salt spray. Even books or paper of neutral and alkaline character are not immune. As neighboring papers of acidic nature degrade, volatile acids are produced which either diffuse through adjoining books or permeate the atmosphere and may ultimately acidify even the "safe or stable" books.

In order to arrest this acidic degradation, paper materials must be deacidified and provided with an alkaline reserve or buffer to retard a return to an acidic state. There are several known processes for deacidifying paper whether bound or unbound. U.S. Pat. Nos. 3,472,611; 3,703,353; 3,676,182; 3,939,091; 3,676,055; 3,969,549; and 4,318,963 are exemplary.

Unfortunately, most of these processes suffer from one or more of a number of drawbacks that have prevented their widespread acceptance. These drawbacks include high cost, toxicity, complexity of treatment, residual odor, deleterious effects on certain types of paper and inks, lack of an alkaline reserve, and the necessity of drying the book or paper to very low moisture contents before treatment.

U.S. Pat. No. 4,522,843 which issued on Jun. 11, 1985 to Robert Kundrot describes a process in which acidic cellulosic materials can be treated in a manner which obviates or minimizes many of the problems of the prior art including the necessity for drying the book or paper prior to treatment. This method can be used on cellulosics (paper) even when such paper is imprinted and bound. More particularly, the Kundrot patent demonstrates that books, imaged paper and other imaged material having a cellulose base can be preserved by treatment with alkaline particles of basic metal oxides, hydroxides or salts (hereinafter referred to as alkaline material) in an amount and for a time sufficient to increase the pH of the material and provide an alkaline buffer or reserve in the pages. The alkaline particles are deposited and adhere tightly to both the fibrous structure of the paper and on the surface.

In the past, as described in the Kundrot patent, the books were dipped vertically into a treatment medium. Following treatment, a small section of each page, adjacent the binding of a book for example, remained untreated, even after repeated dippings. Neutralization of the small section would eventually occur. The mobile acid species in the untreated areas eventually migrate across the page to the particles of basic metal oxides, hydroxides, or salts which are distributed through the cellulosic or paper web of the pages, where they are neutralized. However, this process may take a prolonged period of time until it has been completed. Thus, it is preferable to deacidify the entirety of each page of the book during the treatment process to prevent deterioration of the book. Accordingly, it is desirable to develop a method of handling the cellulosic materials during treatment which ensures that the pages of the book are treated completely by the deacidification process.

Another problem associated with the treatment of cellulosic materials was that the alkaline material was often visible as a powdery substance on the surface of pages after treatment was completed. This detracts from the appearance and utility of the treated books.

Therefore, a method of deacidification is needed which overcomes the aforementioned deficiencies of the methods used in the past and will substantially, and preferably completely, treat each page of a book or other cellulosic material without leaving a visible residue of the treating material.

SUMMARY OF THE INVENTION

A method and apparatus for deacidification of materials such as books, magazines, newspapers, documents and the like is provided which ensures that substantially the entirety of each page of the book is treated. The method includes the steps of submerging cellulosic materials in a bath of a treating medium, and causing relative movement between the cellulosic materials and the treating medium in a generally axial direction relative to the cellulosic materials at a predetermined velocity and continuing such relative movement for a first period of time effective for deacidifying substantially all of the cellulosic materials. Thereafter, the cellulosic materials are dried, preferably in a dryer, by means of flowing a stream of warm air over the cellulosic materials. The relative movement is preferably achieved by moving the cellulosic materials in a generally horizontal, preferably reciprocating motion, through the treating medium at a predetermined speed and over a predetermined distance preferably by controlling the stroke speed and stroke length of a means for providing the reciprocating motion.

Alternatively, the relative movement may flow the treating fluid past the cellulosic materials in an axial direction at the predetermined velocity. The method preferably also includes applying ultrasonic energy to the bath during the treatment process to disperse particles within the treating medium.

The cellulosic materials are placed in a carrier configured to hold the materials in a manner which permits exposure of each page of any such material to the treating medium. A suitable carrier is provided by a V-shaped carrier in which the spine of the book is placed adjacent the apex or spline of the V. The V-shaped carrier includes a plurality of holes therethrough to allow fluid to pass through the holes and to allow securing members, such as clamps to be attached to the V-shaped carrier. A book, for example, may be clamped or otherwise fastened to the sides of the V-shaped carrier such that the front cover of the book is securely attached to one side of the carrier, and the back cover of the book is securely attached to the other side of the carrier. Axial movement of the book or other material is prevented by the use of adjustable stops inserted at desired location in the holes on the carrier's spline. During treatment, the carrier must be held down due to the buoyant force of the books. Following treatment, the book is released. The carrier includes handles which may be gripped to submerge the carrier and its cargo into a vat containing the treating medium, such as a dispersion having particles of an alkaline material. The treating medium is preferably of the type described in U.S. Pat. No. 4,522,843 to Kundrot, the disclosure of which is hereby incorporated by reference.

The vat may be circular, donut shaped or rectangular. It may also include a support frame. In one embodiment, a rectangular support frame is provided which has two opposing longitudinal members and two opposing transverse members configured to support a carrier. The support frame is slidably mounted on the vat. Means are provided which are operatively connected to the support frame which cause the frame to move at the desired velocity, and preferably to reciprocate in a generally horizontal orientation within the vat.

The reciprocating means may include a driving member pivotally attached at one end to the support frame preferably by a clevis and pin arrangement and pivotally attached at its other end to a flywheel. The point of attachment of the driving member to the flywheel can be varied to adjust the stroke length of the driving member. As will be readily apparent to one of ordinary skill in the art, when the driving member is attached to the flywheel at a point closest to the axis of rotation of the flywheel, the reciprocation stroke is relatively short. Conversely, when the driving member is attached to the flywheel further away from the axis of rotation of the flywheel, closer to the perimeter of the fly wheel, the reciprocation stroke is relatively long. The flywheel is rotated by means of a motor, belt and pulley system. A rotating motor rotates a driving pulley via a gear box which is connected by a belt to a driven pulley. As will be apparent to one of ordinary skill in the art, by varying the size of the pulleys, the speed of rotation of the flywheel can be varied. As the speed of rotation of the flywheel is varied the stroke speed of the driving member is also varied.

The reciprocation of the support frame causes corresponding reciprocating movement of the carrier through the medium in the vat. The pages of books secured to the carrier are thereby caused to fan out, and the treating medium thus comes into contact with the full surface areas of each page of each book in the carrier. It has been determined that reciprocation at a stroke length of about 12 inches and a speed of about 12–16 cycles per minute for about fifteen minutes will completely deacidify even the most difficult to treat books. A shorter time period may suffice for other cellulosic materials. The variables of stroke length, stroke speed and time may be changed depending on several factors such as the size of the pages of a book or other document, the number of pages and the pH of the pages or other document prior to treatment. After reciprocating the support frame at a predetermined stroke speed and stroke length for a predetermined period of time such that each page of the book is treated substantially in its entirety, the carrier is removed from the bath. It is then preferably either transported by hand or conveyed automatically to a dryer.

Preferably, the dryer is constructed in the form suitable for receiving the carrier. Alternatively, the dryer may include a holder in the form of fixed shelving or made of flexible meshed webbing or netting which is disposed between each of a series of support rods. The books may be removed from the carrier and placed on the shelving or the meshed webbing. Air, which has preferably been preheated, is circulated through the dryer to evaporate any excess residual treating medium on the surface of the pages. The air stream carries the evaporated residual treating medium from the books to a condenser where it is cooled to form a condensate of the treating medium.

The liquid condensate is preferably collected so that it may be recycled to the vat. Additionally, it is preferable to provide covers on both the vat and the dryer to minimize evaporative losses of the treating medium.

The process described herein ensures that substantially the entirety of each page of the book is treated and deacidified during the treating process. These and other advantages and benefits of the present invention will become apparent from the detailed description of the preferred embodiment hereinbelow.

BRIEF DESCRIPTION OF THE DRAWINGS

The preferred embodiment of the invention will now be described, by way of example only, with reference to the accompanying Figures wherein like members bear like reference numerals and wherein.

DETAILED DESCRIPTION OF THE PREFERRED EMBODIMENT

Figure 1:
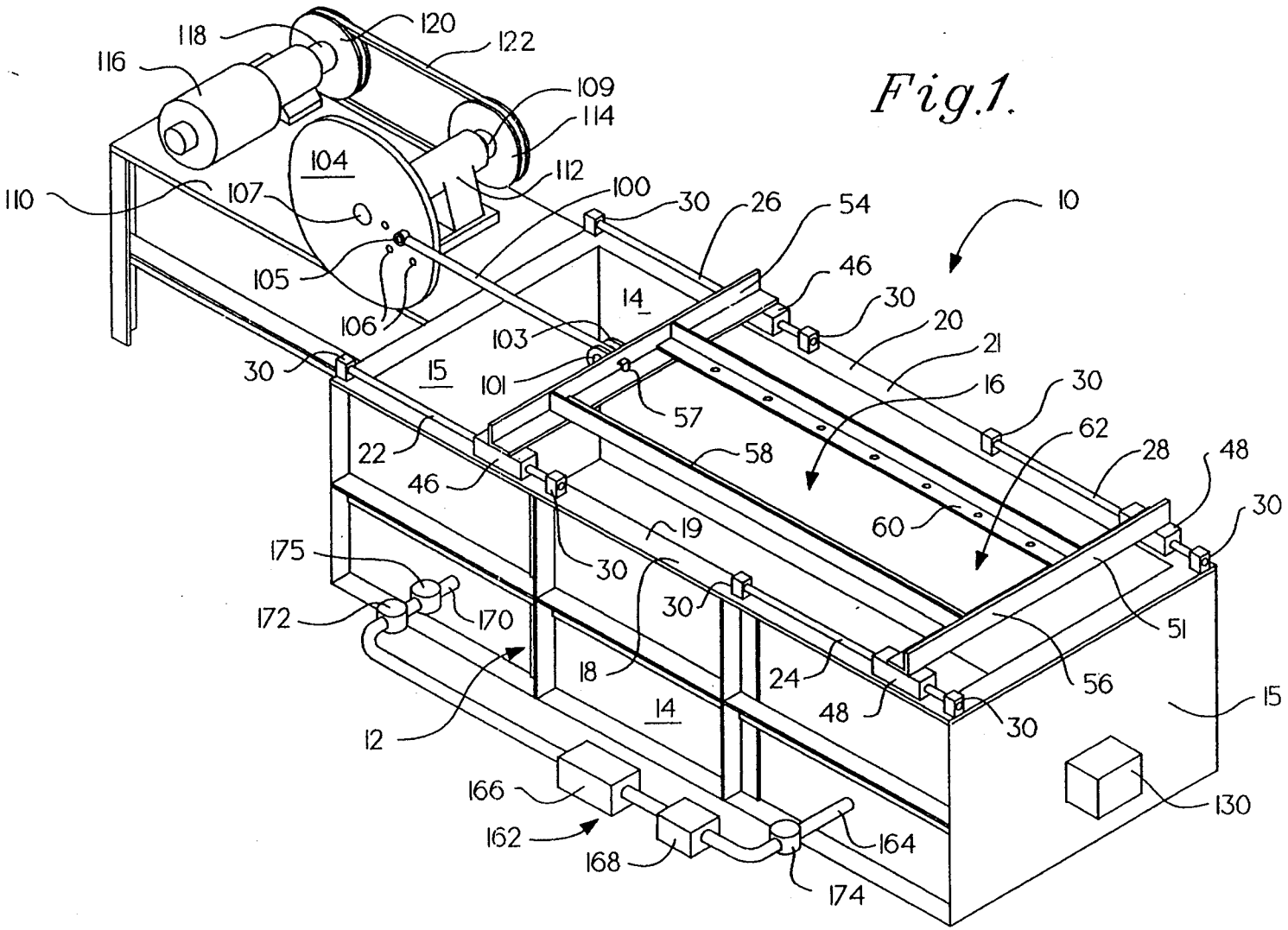
FIG. 1 is a perspective view of the treatment apparatus constructed according to the present invention with the lid removed.
Figure 2:
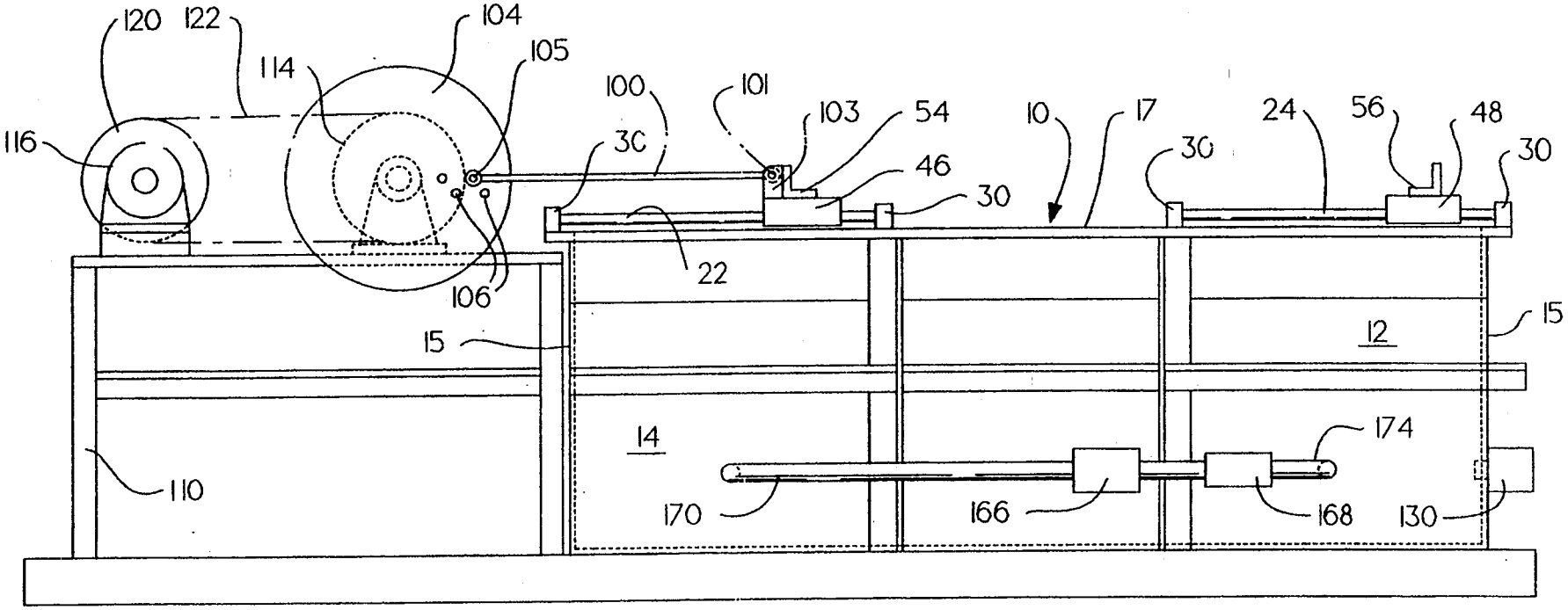
FIG. 2 is a side cross-sectional view of the treatment apparatus of the present invention.
Figure 3:
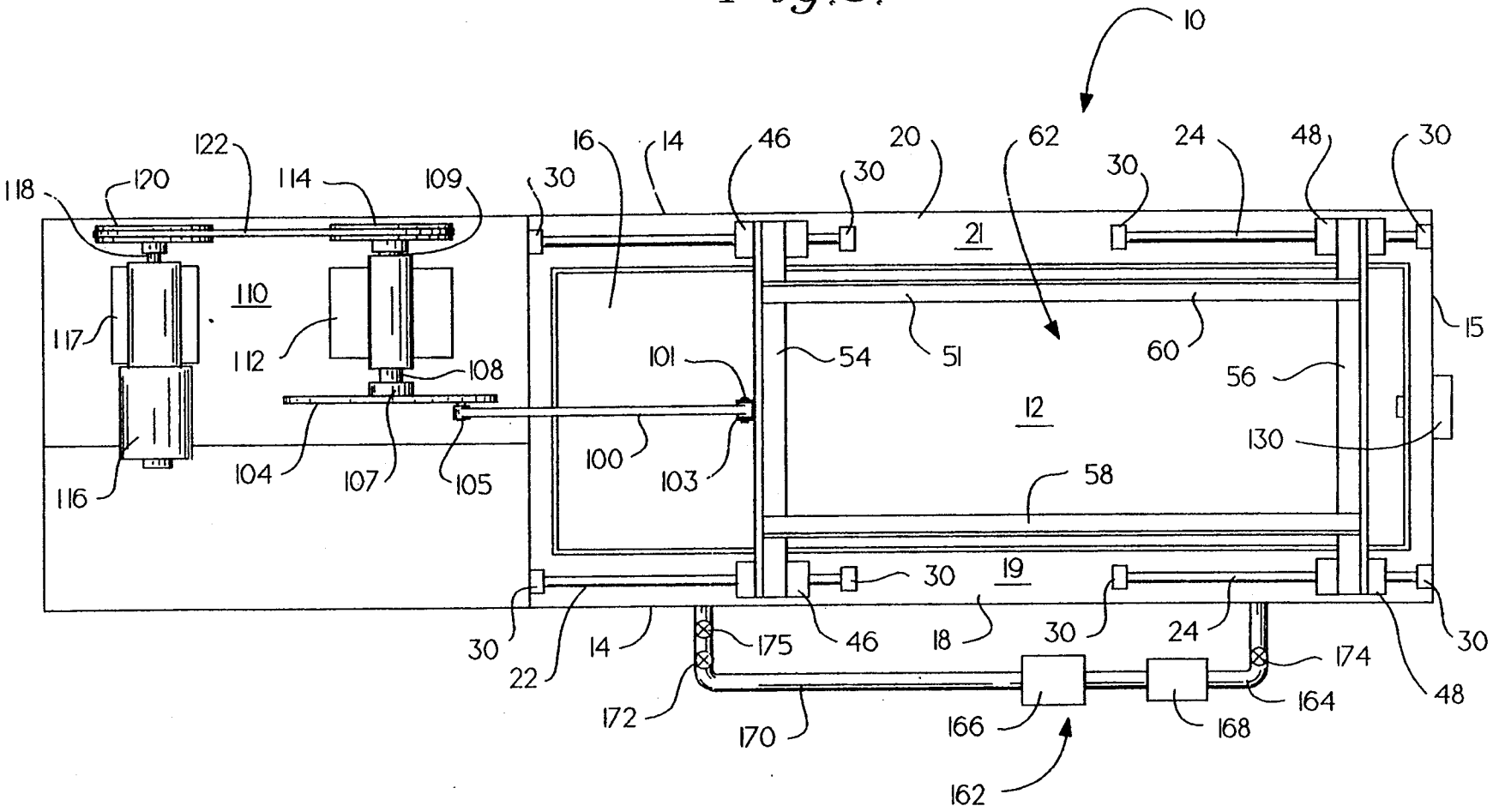
FIG. 3 is a top plan view of the treatment apparatus of the present invention with the lid removed.
Figure 4:
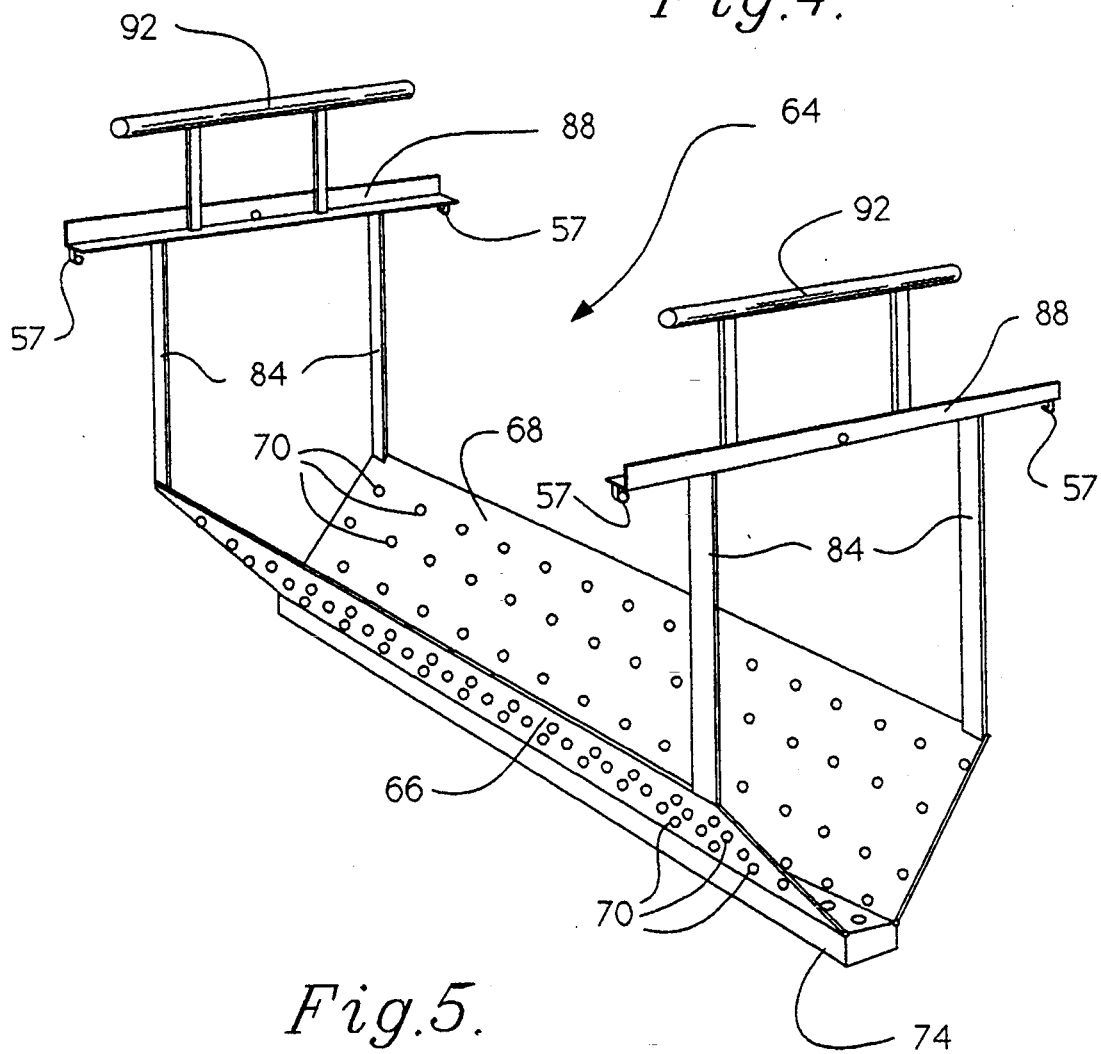
FIG. 4 is a perspective view of a V-shaped carrier of the present invention.
Figure 5:
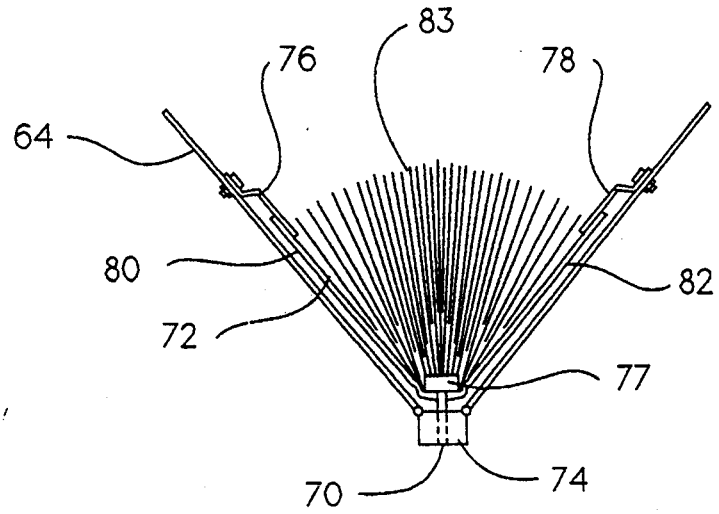
FIG. 5 is a partial end view of the of the V-shaped carrier of FIG. 4 with showing a book placed therein.
Figure 6:
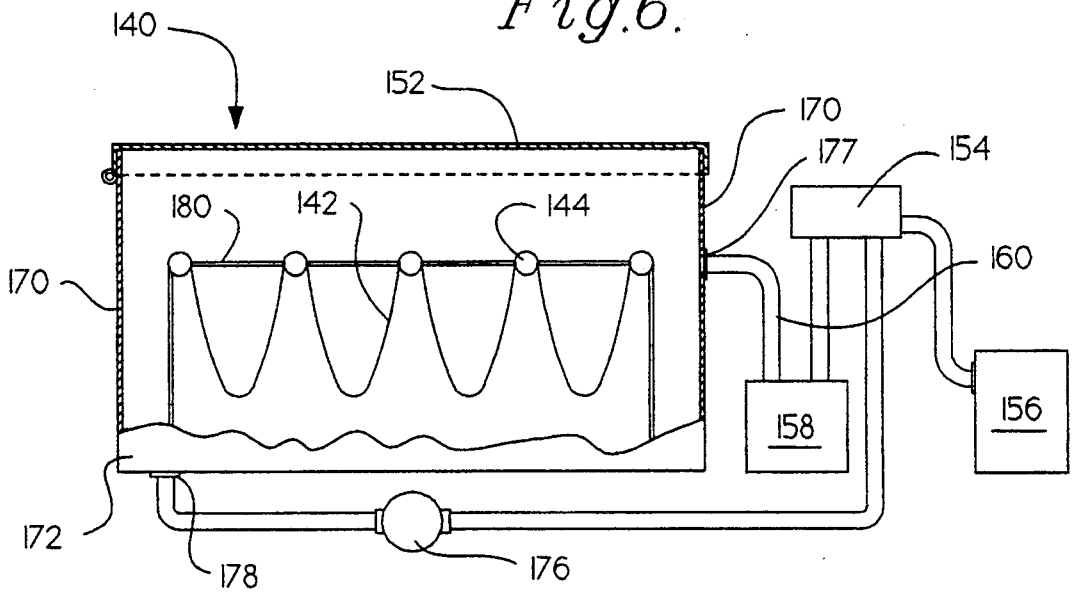
FIG. 6 is a side cross-sectional view of the dryer of the present invention.
Figure 7:
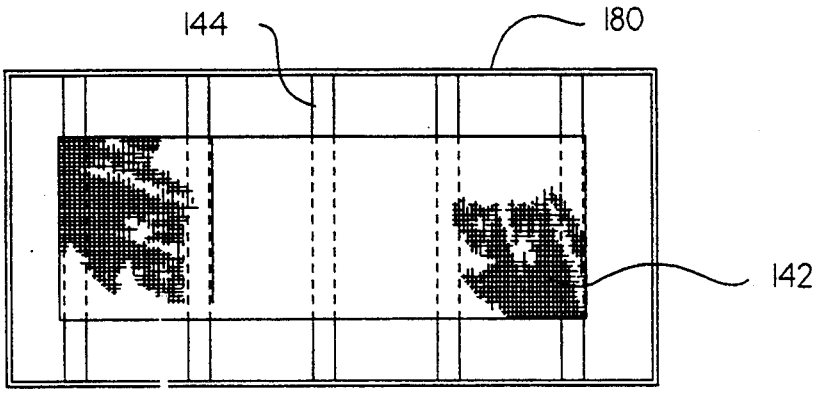
FIG. 7 is a top view of a drying rack for use in the dryer of FIG. 6.

Referring now to the drawings, which are for the purpose of illustrating the preferred embodiment of the invention and not for the purpose of limiting the same, FIGS. 1–5 show the treatment apparatus 10 and FIGS. 6–7 show the drying apparatus used in connection with the process of the present invention.

The treatment apparatus 10 includes generally a tub or vat 12 for holding a bath of treatment medium, a support frame 51 slidably mounted on vat 12, a carrier 64 for holding the cellulosic materials to be treated which is supported in vat 12 by the support frame 51 and means for imparting reciprocating movement in a generally horizontal direction to the support frame 51. The reciprocating movement of the support frame causes corresponding movement of the carrier 64, thereby effecting reciprocation of the cellulosic materials back and forth through the treating medium in a generally horizontal direction. The generally horizontal reciprocating movement of the cellulosic materials through the medium has been found to eliminate the incomplete treatment heretofore experienced. However, any suitable sustained velocity of treatment materials flowing axially past the pages of the cellulose based materials will suffice. A relative bulk flow velocity of up to 5 feet per second between the fluid and the paper should serve as the guideline for relative velocity between the paper and the treatment fluid. Such movement may be achieved, for example, by moving the cellulose based materials in a circular path through the treatment bath in a vat having a circular or donut shape. The movement may be continuous in one direction, or may occasionally be reversed. Alternatively, the book or the cellulose based material may be motionless and the fluid may be moved past the pages at the desired relative velocity in an axial direction, using conventional means, such as, pumps or pistons. In a third embodiment, the cellulose based material and the treatment fluid may both be in motion. For example, the cellulose based materials may be reciprocated as described in more detail below while the treatment fluid simultaneously flows past the reciprocating materials.

The vat 12 is provided for holding the treating medium of preferably alkaline materials, and more preferably a liquid dispersion of particles of a basic metal oxide, hydroxide or salt, as described above. The vat 12 shown in the drawings has four sides, two longitudinal sides 14 and two transverse sides 15. The longitudinal sides 14 of the vat 12 have attached thereto horizontally disposed support members 18 and 20. Horizontal support member 18 has attached thereto, at each end of its upper side 19, bearing rods 22 and 24. Similarly, horizontal support member 20 has attached thereto, at each end of its upper side 21, bearing rods 26 and 28. The bearing rods are constructed of a durable, rigid material such as, for example, bearing steel. The bearing rods 22, 24, 26 and 28 are spaced from and supported above the associated horizontal support members 18, 20 by vertical rod holders 30. Each bearing rod has a block 46 or 48 attached thereto such that each block 46, 48 may slide back and forth on its associated bearing rod in the horizontal plane. As stated above, however, the vat 12 can assume a variety of shapes depending on the method chosen for effecting relative movement between the pages and the treating fluid.

The support frame 51 includes a frame made up of support members, which may be in the form of rods, bars, or lines. In one embodiment, a transverse angled member 54 is rigidly attached at each end to opposing blocks 46 on opposing support members 18,20. Similarly, a transverse angled member 56 is rigidly attached at each end to opposing blocks 48. Member 54 is preferably parallel to member 56. Parallel spaced longitudinal angled members 58 and 60 operatively connect members 54 and 56 by spanning the distance between members 54 and 56. Other known means of operatively connecting members 54 and 56 may be provided. A rectangular opening 62 is defined by transverse angled members 54 and 56 and longitudinal angled members 58 and 60 which can move in the longitudinal direction over vat 12 when blocks 46, 48 slide along bearing rods 22, 24, 26 and 28. Those of ordinary skill in the art will also recognize that angled members 54, 56, 58 and 60 can alternatively be made of a variety of shapes and are shown as angled members for illustration purposes only.

Turning now to FIGS. 4–5, a carrier for supporting the books during treatment is shown in the form of a V-shaped carrier 64. Each carrier 64 may support several books or other materials. V-shaped carrier 64 has adjustable angled sides 66 and 68 and a spline 74 to permit change of the angle of the V. The angled sides 66, 68 and spline 74 have a plurality of holes 70 therethrough. The V-shaped carrier 64 is designed such that the books 72 or any other types of cellulosic materials in booklet or bound form to be treated may be placed end to end between the angled sides 66 and 68 with the spine of the book or booklet adjacent the apex of the V at spline 74. Means, such as clamp members 76 and 78 are used to attach the front cover 80 and back cover 82, respectively, to a desired location on the V-shaped carrier 64 utilizing holes 70. Clamp members 76 and 78 are secured by means of a bolt, screw or other fastener passed through a hole 70. Other suitable means for securing the materials to the carrier 64 may be provided, such as, for example, netting, strapping or suction means. Axial stops 77 are placed in the holes 70 in the spline 74 of the carrier 64 to prevent axial motion of books. The V-shaped carrier 64 includes vertical members 84 which have attached thereto horizontal support members 88. Additionally, handles 92 project above horizontal support members 88 to permit carrier 64 to be easily grasped. The V-shaped carrier 64 is constructed such that it may be inserted into the preferably rectangular opening 62 and the horizontal support members 88 may be supported anywhere along the longitudinal angled members 58 and 60. In this way, several carriers 64 may be lined up in series in support frame 51 to treat many books simultaneously. Alternatively, a single carrier 64 may be used or multiple carriers 64 may be placed in parallel. In the latter situations, the transverse angled members 54, 56 can be used to support the carrier's support members 88. Locking members such as hooks 57 or clamps are provided on members 54 and 56 or on support members 88 to secure carrier 64 within frame 51 to counteract the buoyant forces of the books in the treating medium.

Carrier 64 may assume other shapes. It must be constructed in a manner which permits the particular cellulosic materials to be treated to be securely held in the carrier during treatment and must permit complete exposure of the cellulosic material the treating medium. Documents, for example, may be held in a box like carrier that includes slots or an accordion style slotted carrier of any open weave, grid or mesh construction to permit fluid passage among the slots. A mesh type screen to fully enclose loose pages which could otherwise float away should also be provided. Another alternative is to provide a flat plate to which the V shaped carrier, the box like carrier or any other holder can be fastened.

The means for imparting reciprocating movement to the support frame 51 is preferably provided by a motor 116 having a gear box 117 attached by pulleys 114, 120 to a flywheel 104 which is in turn connected to the support frame 51 by a drive member or drive arm 100. Drive member 100 is pivotally attached to transverse angled member 54 by means of a pin 101 through a clevis 103. The drive member 100 is rotatably attached to the flywheel 104 by means of a pin 105 in one of several attachment points or holes 106. A shaft 108 extends outwardly from the center of the flywheel 104. The shaft 108 is attached at its other end 109 to a pulley 114. Pulley 114 is operatively connected by means of belt 122 to second pulley 120. Pulley 120 is driven by drive rod 118 which extends from gear box 117. Motor 116, gear box 117 and bearings 112 are attached to a base 110. Pulley 120 lies in the same plane as pulley 114. Instead of the belt and pulley drive, it will be recognized that other suitable drive mechanisms may be utilized, such as, for example, gear drives or piston (hydraulic or pneumatic) drives to achieve varying stroke length and speed. Alternatively, a variable speed drive directly coupled to the flywheel may be provided to avoid changing the pulleys. A further alternative is to use a pendulum-type drive to swing the books through the medium. The movement in this case is not truly horizontal, but is more arcuate in a generally horizontal direction. As stated, the relative flow velocity is believed to be the critical movement criteria.

In operation, motor 116 and gear box 117 rotate pulley 120 which, through belt 122, turns pulley 114. As this occurs, flywheel 104 rotates which in turn moves the driving member 100; because the driving member 100 is pivotally attached to frame 51 via transverse angled member 54, the support frame 51 reciprocates. Accordingly, the carrier 64 reciprocates within the vat 12 causing the book 72 and other cellulosic materials to be pulled back and forth through the medium in the vat 12 in a generally horizontal orientation at a predetermined speed and over a predetermined length. The reciprocating movement of the book 72 causes the pages of the book to fan out as shown in FIG. 5, thereby exposing the entire surface of each page of each such book to the treating medium within vat 12.

Tests were done to determine the stroke lengths and stroke speeds of drive member 100 that provide the most thorough treatment of the books. The results are shown in the following Tables. Each run was tested with a relatively large volume from an encyclopedia (Colliers) and a relatively smaller book, such as a text book or a novel, some less than half the size in area and page numbers as the encyclopedia volumes. The book types are designated (L) for large and (S) for small. The pH of the books was measured before (B) and after (A) treatment at several locations on various pages within the books treated. A swab of chlorophenol red was used to spot the test locations. Nine spots were checked per page tested. The chlorophenol red turns purple when thee pH become alkaline.

As the test results below demonstrate the pH of every page tested and at every section of every page tested was raised from the acidic values measured before treatment to the alkaline values measured after treatment. The treatment method of the present invention even raised the pH of the area adjacent the spine of the books, which heretofore had been difficult to effectively deacidify.

The chlorophenol red swab spot test demonstrates that improved results are obtained by varying the stroke length and stroke speed of the drive member 100. It can be seen also that large books appear to fair better with a longer stroke length at a slower speed. For example, runs 4 and 5 show that a speed of 12–16 rpm and a stroke length of 12 inches resulted in 100% deacidification for both large and small books, whereas runs 8 and 9 demonstrate that small books faired better than large books when the stroke speed was 23 rpm. The poorest results for large books were obtained in runs 3 and 6 when the stroke length was reduced to four inches.

TREATING TRIALS

| Run No. | Speed (rpm) | Stroke Length (inches) | Treatment Time (minutes) | Book Type (Large or Small) |
|---|---|---|---|---|
| 1 | 12 | 12 | 15 | L |
| 1 | 12 | 12 | 15 | S |
| 2 | 12 | 8 | 15 | L |
| 2 | 12 | 8 | 15 | S |
| 3 | 12 | 4 | 15 | L |
| 3 | 12 | 4 | 15 | S |
| 4 | 12 | 12 | 25 | L |
| 4 | 12 | 12 | 25 | S |
| 5 | 16 | 12 | 15 | L |
| 5 | 16 | 12 | 15 | S |
| 6 | 16 | 4 | 15 | L |
| 6 | 16 | 4 | 15 | S |
| 7 | 23 | 12 | 15 | L |
| 7 | 23 | 12 | 15 | S |
| 8 | 23 | 12 | 25 | L |
| 8 | 23 | 12 | 25 | S |
| 9 | 23 | 8 | 15 | L |
| 9 | 23 | 8 | 15 | S |

pH Measurements (Before & After Treatment)

| Run | | pH-Left-Top | | pH-Left-Btm | | pH-Center | |
|---|---|---|---|---|---|---|---|
| No. | Page | B | A | B | A | B | A |
| 1 | 331 | 5.1 | 8.8 | 5 | 8.9 | 5.1 | 9 |
| 1 | 165 | 4.7 | 9 | 4.7 | 8.8 | 4.7 | 9.2 |
| 2 | 361 | 5 | 8.6 | 5 | 9 | 4.9 | 9.1 |
| 2 | 119 | 4.5 | 8.9 | 4.4 | 8.9 | 4.4 | 9.1 |
| 3 | 321 | 5.4 | 8.8 | 5 | 8.8 | 5 | 8.9 |
| 3 | 143 | 4.8 | 8.7 | 4.4 | 9 | 4.4 | 9 |
| 4 | 339 | 5.6 | 8.4 | 4.9 | 9 | 5.2 | 8.5 |
| 4 | 99 | 5.9 | 9.4 | 5.6 | 8.7 | 5.6 | 9.2 |
| 5 | 381 | 5.3 | 8.8 | 5.5 | 8.9 | 4.9 | 9.1 |
| 5 | 175 | 5 | 8.9 | 4.6 | 9.2 | 4.6 | 9.2 |
| 6 | 529 | 5.7 | 8.6 | 5 | 8.9 | 5.2 | 8.9 |
| 6 | 127 | 4.9 | 8.4 | 4.6 | 8.9 | 4.6 | 8.7 |
| 7 | 371 | 5.7 | 9 | 5 | 9.2 | 4.9 | 9.2 |
| 7 | 281 | 5.1 | 9 | 5 | 8.8 | 4.7 | 9.2 |
| 8 | 407 | 5.4 | 9 | 5.2 | 9.2 | 5.2 | 9.2 |
| 8 | 187 | 4.9 | 9.5 | 4.9 | 9.4 | 4.8 | 9.5 |
| 9 | 383 | 5.6 | 9.1 | 5.2 | 9.1 | 5.1 | 9.1 |
| 9 | 131 | 4.9 | 8.9 | 4.7 | 9.3 | 4.6 | 9.1 |

pH Measurements (Before & After Treatment)

| Run | pH Rgt-Top | | pH-Rgt-Btm | | pH-Ctr-Spine | |
|---|---|---|---|---|---|---|
| No. | B | A | B | A | B | A |
| 1 | 4.8 | 8.6 | 5 | 8.8 | 4.7 | 9 |
| 1 | 4.8 | 8.6 | 4.9 | 8.7 | 4.7 | 9 |
| 2 | 5.3 | 8.9 | 5 | 9 | 5.1 | 9.1 |
| 2 | 4.6 | 8.8 | 4.6 | 8.7 | 4.3 | 9.1 |
| 3 | 5.3 | 8.6 | 5 | 8.7 | 5 | 9.1 |
| 3 | 4.7 | 8.7 | 4.2 | 8.8 | 4.6 | 8.6 |
| 4 | 5.3 | 9 | 5 | 8.8 | 4.9 | 8.7 |
| 4 | 5.7 | 9 | 5.9 | 9.3 | 5.9 | 9.3 |
| 5 | 5.4 | 8.6 | 5 | 9 | 5 | 9.1 |
| 5 | 4.9 | 9.2 | 4.8 | 9.3 | 4.8 | 9 |
| 6 | 5.4 | 8.7 | 5.1 | 8.7 | 4.9 | 8.1 |
| 6 | 4.9 | 8.3 | 4.7 | 8.8 | 4.9 | 9 |
| 7 | 5.2 | 9.1 | 5 | 9 | 4.8 | 9.2 |
| 7 | 5.3 | 9.1 | 5.1 | 9 | 4.8 | 9 |
| 8 | 5.5 | 9 | 5.2 | 9.2 | 5.1 | 9 |
| 8 | 5.1 | 9.4 | 4.8 | 9.5 | 5 | 9.3 |
| 9 | 5.5 | 9 | 5.2 | 9.1 | 5.1 | 8.8 |
| 9 | 4.9 | 9.2 | 4.7 | 9 | 4.8 | 9.1 |

Completeness of Treatment - Chlorophenol Red Swab Spot Test
Nine (9) Spots Checked Per Page

| | Number of Treated (purple) Spots on Page | | | | | |
|---|---|---|---|---|---|---|
| Run No. | Ctr of Book | ¼ Way Into Book | ⅛ Way Into Book | 5 Pages In From Cover | Percent of Book Treated | Avg. % of Book Treated For Each Run |
| 1 | 7 | 8 | 9 | 9 | 91.7 | |
| 1 | 9 | 8 | 8 | 9 | 94.4 | 93.1 |

-continued

| TREATING TRIALS | | | | | | |
|---|---|---|---|---|---|---|
| 2 | 9 | 7 | 9 | 9 | 94.4 | |
| 2 | 9 | 9 | 8 | 9 | 97.2 | 95.8 |
| 3 | 9 | 6 | 6 | 9 | 83.3 | |
| 3 | 9 | 6 | 8.5 | 8.5 | 88.9 | 86.1 |
| 4 | 9 | 9 | 9 | 9 | 100.0 | |
| 4 | 9 | 9 | 9 | 9 | 100.0 | 100.0 |
| 5 | 9 | 9 | 9 | 9 | 100.0 | |
| 5 | 9 | 9 | 9 | 9 | 100.0 | 100.0 |
| 6 | 6 | 5 | 5 | 9 | 69.4 | |
| 6 | 9 | 9 | 7 | 9 | 94.4 | 81.9 |
| 7 | 9 | 8 | 8 | 9 | 94.4 | |
| 7 | 9 | 7 | 8 | 9 | 91.7 | 93.1 |
| 8 | 8 | 9 | 9 | 9 | 97.2 | |
| 8 | 9 | 9 | 9 | 9 | 100.0 | 98.6 |
| 9 | 7 | 8 | 9 | 9 | 91.7 | |
| 9 | 9 | 9 | 9 | 9 | 100.0 | 95.8 |

To facilitate the contact between the book 72 and the particles suspended within the medium in vat 12, sonic energy can be introduced into the vat 12 by an ultrasonic generator 130 which breaks up and prevents the formation of agglomerates of particles and causes the particles to disperse. The ultrasonic generator may be run continuously or periodically during the treatment process, as needed. If desired, a recirculation system 162 may be used in connection with the vat 12 to provide movement of the fluid through the vat 12 and also to filter the fluid In the vat 12. A pipe 170 is in fluid communication with the vat 12 such that fluid may flow out of the vat 12 when a suitable valve 175 is opened. Fluid is drawn out of the vat 12 by pump 166 and passes through filter 168 before flowing back into the vat 12 through line 164. If desired, valves 172 and 174 may be provided to allow for the vat 12 to be drained either before or after passing the fluid through filter 168.

After the books 72 have been exposed to the treating medium for a predetermined period of time effective for deacidifying the book, they are dried. The dryer may be a separate unit or a separate section within an interconnected system or may be part of the vat 12. In the latter embodiment, the treating fluid would be drained from the vat and transferred to a holding tank (not shown). Warm air may be piped into vat 12 as described below for dryer 140.

Turning to FIGS. 6–7, a separate dryer 140 is shown. It includes a rack 180 made of flexible meshed webbing 142 secured to rods 144. The webbing drapes loosely between adjacent rods. Each rod 144 is attached to the top portion of a rectangular frame. The dryer 140 has four sides 170, a bottom 172 and is preferably covered by a lid 152 to define an enclosed chamber. A closed drying system is thereby provided. Following treatment, the books 72 are moved into dryer 140. The books or other cellulosic materials may be placed on the meshed webbing 142. Alternatively, the carrier 64 may be lifted from vat 12 and transferred to the chamber of the dryer 140. A further alternative is to provide fixed shelving in the dryer 140 or some other support surface. Whatever the means of supporting the materials, the meshed webbing of the rack, the fixed shelving or support surface and the carrier must be structured to allow air flow to contact the books and other documents placed therein. Drying occurs preferably by means of flowing a stream of warm air over the books 72. Alternatively, evaporation at room temperature may be employed. The temperature and humidity are preferably controlled, however, to optimize recovery of treating fluid without damaging the books. The temperature must not be so high, nor the humidity level so low that the books or other documents would be damaged. The precise temperature and humidity levels will depend on the types of materials being treated, including the bindings and cover materials.

In the preferred method of drying, air is warmed in a heater 158 and passed into the chamber (whether dryer 140 or vat 12) through an inlet 177 in an end wall of the chamber. It is drawn through the chamber and over and around the books by means of a pump 176 proximate the outlet 178 at the bottom of the chamber. The warm air evaporates any excess residual treating medium on the pages. As indicated above, treating material will be retained in and on the pages as a reserve. The excess residual medium referred to herein is not the alkaline particles held in the fibers or on the surface of the pages as reserve but is the medium in which the alkaline particles had been dispersed and now lies unattached or unbound on the surface of the pages. Air is removed from the dryer 140 through the outlet and may be directed to a condenser 154. In the condenser 154, the air stream is cooled and the excess residual medium is thereby condensed out of the air. The resulting condensate is then preferably drained into a collector 156. Water may also condense. It is separated, usually by decanting, prior to reusing the treating medium. The now cooled air is then preferably directed back to the heater 158 where it is again warmed and circulated back into the dryer 140 through line 160. The air path thus defined is a closed system which permits recycling of excess treating medium and prevents exposure of workers to vapors. In alternative arrangements, the condensing coils may be placed directly in the drying chamber employing natural circulation to condense treating materials evaporated from the treated materials.

If desired, a conveyor (not shown) could connect the vat 12 to the dryer 140. The conveyor would provide automatic transfer of a carrier 64 from the vat 12 to the dryer 140. The conveyor would preferably be enclosed in a housing (not shown) to minimize evaporative losses of the treating medium.

Although the present invention has been described primarily in conjunction with books, the invention may be used with other types of cellulosic material such as magazines, newspaper, maps, documents and the like. Those of ordinary skill in the art will appreciate the fact that there are a number of modifications and variations that can be made to specific aspects of the method and apparatus of the present invention without departing from the scope of the present invention. Such modifications and variations are intended to be covered by the foregoing specification and the following claims.

What is claimed is:

1. A method of deacidifying cellulosic materials in a treating medium comprising the steps of:

submerging cellulosic materials comprised of bound and folded materials having a spine in a bath of treating medium;

causing relative movement between the cellulosic materials and the medium in a direction generally parallel to the spine of the materials at a velocity sufficient to ensure exposure of the cellulosic materials to the medium;

continuing the relative movement for a first period of time effective for deacidifying substantially all of the cellulosic materials; and drying the cellulosic materials.

2. The method of claim 1 wherein the relative movement comprises moving the cellulosic materials in a generally horizontal direction through the medium.

3. The method of claim 1 wherein the step of causing relative movement comprises reciprocating the cellulosic materials through the medium at a speed and over a length sufficient to achieve the said velocity.

4. The method of claim 3 further comprising the step of supporting a carrier in a reciprocating support frame within the bath.

5. The method of claim 4 wherein the support frame is operatively connected to a driving member and the driving member is attached to one of a plurality of attachment points of a rotating member to provide a stroke length sufficient for achieving the said length of reciprocating motion through the medium and the step of moving the cellulosic materials further comprises translating the driving member by rotating the rotating member at a stroke speed sufficient to achieve the said speed of reciprocating motion.

6. The method of claim 2 wherein the relative movement comprises moving the cellulosic materials in a circular path.

7. The method of claim 1 further comprising the step of applying to the bath of treating medium ultrasonic energy to disperse particles in the medium.

8. The method of claim 1 wherein the relative movement is provided by circulating the medium in the bath past the cellulosic materials.

9. The method of claim 1 wherein the relative movement is provided by simultaneously circulating the medium in the bath past the cellulosic materials and moving the cellulosic materials through the medium to achieve the said velocity.

10. The method of claim 1 wherein the relative movement is provided by circulating the medium from the bath, through a filter and back into the bath past the cellulosic materials.

11. The method of claim 1 further comprising, following the first period of time, transporting the cellulosic materials from the bath to a dryer for the drying step.

12. The method of claim 1 wherein the step of submerging the cellulosic materials in the medium comprises placing the cellulosic materials in a carrier configured to hold the cellulosic materials in a manner which permits exposure of all surfaces on the cellulosic materials to the medium and submerging the carrier into the medium.

13. The method of claim 12 wherein the step of drying comprises transferring the carrier holding the cellulosic materials to a dryer.

14. The method of claim 12 wherein the carrier comprises a substantially V-shape holder having a plurality of openings for passage of medium therethrough and the step of placing the cellulosic materials in the carrier comprises the step of releasably securing the cellulosic materials to the holder.

15. The method of claim 1 wherein the step of drying the cellulosic material comprises passing a stream of warm air over the cellulosic materials.

16. The method of claim 1 wherein the drying step further comprises:

a) placing the cellulosic material in a drying chamber;
b) heating a stream of air in a heater;
c) flowing the heated stream of air into the chamber and over the cellulosic medium to evaporate any excess residual treating medium from the cellulosic material;
d) withdrawing the stream of air from the chamber by means of a pump and cooling the stream of air such that any residual treating medium present in the stream of air condenses to form a condensate;
e) collecting the condensate;
f) returning the stream of air to the heater; and
g) repeating steps b) through f) for a second period of time sufficient to remove substantially all of the excess residual treating medium from the cellulosic material.

17. The method of claim 16 wherein step a) comprises placing the cellulosic material on a flexible webbing within said drying chamber.

18. A method of deacidifying cellulosic materials in a medium containing particles of a treating material comprising the steps of:

placing the cellulosic materials in a carrier;
submerging the carrier in a bath of the medium;
supporting the carrier in a movable support frame within the bath of the medium;
subjecting the bath of medium to ultrasonic energy to disperse the particles of treating material in the medium;
translating a driving member attached at one end thereof to a rotating member and at the other end thereof to the support frame such that the support frame is reciprocated at a stroke speed and through a stroke length for reciprocating the cellulosic materials through the medium in a generally horizontal direction for a first period of time effective for deacidifying the cellulosic materials;
transporting the cellulosic materials from the bath to a dryer; and
flowing a preheated air stream over the cellulosic materials within the dryer for a second period of time effective for evaporating excess residual medium from the surface of the cellulosic materials.

19. An apparatus for deacidifying cellulosic materials in a treatment medium including suspended alkaline particles, comprising;

a vat for containing a bath of treatment medium;
a support frame slidably mounted on said vat;
a carrier for holding cellulosic materials removably supported by said support frame such that said carrier is positioned in said vat when said carrier is supported by said support frame; and
means for reciprocating said support frame in a generally horizontal linear direction.

20. An apparatus for deacidifying cellulosic materials in a treatment medium including suspended alkaline particles, comprising;

a vat for containing a bath of treatment medium;
a support frame slidably mounted on said vat;.
a carrier for holding cellulosic materials removably supported by said support frame such that said carrier is positioned in said vat when said carrier is supported by said support frame; and
means for reciprocating said support frame in a generally horizontal linear direction comprising a rotating flywheel operatively connected to said support frame to provide reciprocating translational movement of said support frame and means for rotating said flywheel at said stroke speed.

21. The apparatus of claim 20 wherein said flywheel includes a plurality of attachment points and said means for reciprocating said support frame further comprises a driving member having one end attached to said support frame and another end releasably attached to a selected one of said plurality of attachment points for selectively altering the stroke length.

22. The apparatus of claim 20 further comprising means for drying said cellulosic materials comprised of:

a housing for holding said cellulosic material, said housing having an inlet and an outlet;

means for heating an air stream and passing said heated air stream through said inlet to said housing;

means fluidly attached to said outlet for condensing treatment medium from said air stream;

means for collecting condensate from the condensing means; and pump means for circulating said air stream from said heating means, through said housing, to said condensing means and back to said heating means.

23. An apparatus for deacidifying cellulosic materials in a treatment medium comprising:

a vat for containing the treatment medium;

a support frame mounted in the vat;

at least one carrier supported by the support frame for holding cellulosic materials within the vat, the cellulosic materials comprised of bound and folded materials having a spine; and means for causing relative movement between the cellulosic materials and the treatment medium in a direction generally parallel to the spine of the materials at a velocity and for a period of time sufficient for ensuring exposure of substantially all areas of the cellulosic materials to the treatment medium when the cellulosic materials are held in the carrier.

24. The apparatus of claim 20 further comprising means for drying the cellulosic materials.

25. An apparatus for deacidifying cellulosic materials in a treatment medium comprising:

a vat for containing the treatment medium;

a support frame mounted in the vat;

at least one carrier supported by the support frame for holding cellulosic materials within the vat, the cellulosic materials comprised of bound and folded materials having a spine;

means for causing relative movement between the cellulosic materials and the treatment medium in a direction generally parallel to the spine of the materials at a velocity and for a period of time sufficient for ensuring exposure of substantially all areas of the cellulosic materials to the treatment medium when the cellulosic materials are held in the carrier; and, means for circulating the treatment medium through the vat to affect flow of the medium in a direction generally parallel to the spine of the materials.

26. The apparatus of claim 25 wherein the vat has an inlet opening and an outlet opening and the circulating means comprises a system having conduit means in fluid communication with the vat at the inlet and outlet openings, valve means and a pump for drawing treatment medium from the vat through the conduit means and back to the vat upon actuation of the valve means.

27. The apparatus of claim 26 further comprising a holding tank for draining the treatment medium from the vat.

28. The apparatus of claim 27 further comprising a cover for the vat and means for drying the cellulosic materials within the vat.

29. The apparatus of claim 25 wherein the support frame is slidably mounted in the vat and the means for causing relative movement comprises means for reciprocating the support frame within the vat at a stroke length and stroke speed sufficient to achieve the said velocity when the vat is filled with the treatment fluid.

* * * * *